US007476366B2

(12) United States Patent
Maus et al.

(10) Patent No.: US 7,476,366 B2
(45) Date of Patent: Jan. 13, 2009

(54) CATALYST CARRIER BODY WITH CORRUGATED CASING AND PROCESS FOR PRODUCING THE SAME

(75) Inventors: Wolfgang Maus, Bergisch Gladbach (DE); Jörg-Roman Konieczny, Siegburg (DE); Ferdi Kurth, Mechernich (DE); Udo Schmidt, Neunkirchen (DE); Alex Löwen, Troisdorf (DE); Ludwig Wieres, Overath (DE)

(73) Assignee: Emitec Gesellschaft fuer Emissionstechnologie mbH, Lohmar (DE)

( * ) Notice: Subject to any disclaimer, the term of this patent is extended or adjusted under 35 U.S.C. 154(b) by 538 days.

(21) Appl. No.: 10/967,750

(22) Filed: Oct. 18, 2004

(65) Prior Publication Data

US 2005/0106084 A1 May 19, 2005

Related U.S. Application Data

(63) Continuation of application No. PCT/EP03/02678, filed on Mar. 14, 2003.

(30) Foreign Application Priority Data

Apr. 18, 2002 (DE) ..... 102 17 259

(51) Int. Cl.
*B01D 50/00* (2006.01)

(52) U.S. Cl. ..... 422/180; 422/168; 422/177

(58) Field of Classification Search ..... 422/171, 422/174, 180, 168, 177; 502/439
See application file for complete search history.

(56) References Cited

U.S. PATENT DOCUMENTS

| | | | | |
|---|---|---|---|---|
| 4,500,099 | A | 2/1985 | Kitagawa et al. | |
| 4,548,427 | A * | 10/1985 | Press et al. | 285/55 |
| 4,948,774 | A * | 8/1990 | Usui et al. | 502/439 |
| 5,002,923 | A * | 3/1991 | Koshiba et al. | 502/439 |
| 5,026,611 | A | 6/1991 | Usui et al. | |
| 5,079,210 | A | 1/1992 | Kaji et al. | |
| 5,094,821 | A * | 3/1992 | Hitachi et al. | 422/180 |
| 5,110,561 | A * | 5/1992 | Hitachi et al. | 422/180 |
| 5,137,696 | A * | 8/1992 | Hitachi et al. | 422/180 |

(Continued)

FOREIGN PATENT DOCUMENTS

CA 1 270 204 6/1990

(Continued)

*Primary Examiner*—Walter D Griffin
*Assistant Examiner*—Huy-Tram Nguyen
(74) *Attorney, Agent, or Firm*—Laurence A. Greenberg; Werner H. Stemer; Ralph E. Locher

(57) ABSTRACT

A catalyst carrier body has a geometrical longitudinal axis, a honeycomb body and a housing. A corrugated casing with an outer side and an inner side is disposed between the honeycomb body and the housing. The corrugated casing is connected to the housing at attachment sections on the outer side thereof by brazing. The attachment sections lie substantially on a common circumferential line and have the narrowest possible width in direction of a longitudinal axis. The attachment sections have an overall surface area permitting them to securely hold the honeycomb body under operating conditions. A high retention degree for the connection between the honeycomb body and housing can thus be achieved even with a shrinking of the diameter of the honeycomb body at end sides during the service life thereof.

27 Claims, 3 Drawing Sheets

U.S. PATENT DOCUMENTS

| | | | | | |
|---|---|---|---|---|---|
| 5,272,875 | A | * | 12/1993 | Kaji | 60/299 |
| 5,346,675 | A | * | 9/1994 | Usui et al. | 422/180 |
| 5,380,501 | A | * | 1/1995 | Hitachi et al. | 422/180 |
| 5,456,890 | A | * | 10/1995 | Tsai et al. | 422/174 |
| 5,620,666 | A | * | 4/1997 | Usui | 422/171 |
| 5,656,245 | A | * | 8/1997 | Fujisawa et al. | 422/179 |
| 5,851,496 | A | * | 12/1998 | Sakurai | 422/174 |
| 6,040,064 | A | * | 3/2000 | Bruck et al. | 428/593 |
| 6,080,371 | A | * | 6/2000 | Tanabe et al. | 422/180 |
| 6,673,466 | B2 | | 1/2004 | Brück et al. | |
| 6,689,328 | B1 | * | 2/2004 | Otani et al. | 422/180 |
| 7,048,895 | B2 | * | 5/2006 | Shirahata et al. | 422/180 |
| 2001/0009650 | A1 | * | 7/2001 | Kodama et al. | 422/177 |
| 2003/0007906 | A1 | * | 1/2003 | Nagel et al. | 422/180 |

FOREIGN PATENT DOCUMENTS

| | | | | |
|---|---|---|---|---|
| DE | 37 43 723 | C1 | | 4/1989 |
| DE | 39 22 264 | A1 | | 2/1990 |
| DE | 39 26 072 | A1 | | 2/1991 |
| DE | 100 18 641 | A1 | | 10/2001 |
| DE | 100 26 697 | A1 | | 12/2001 |
| EP | 0 245 737 | A1 | | 11/1987 |
| EP | 0 784 507 | B1 | | 7/1997 |
| JP | 04 222 636 | | | 8/1992 |
| JP | 04 334 719 | | | 11/1992 |
| WO | 90/03220 | | | 4/1990 |
| WO | WO 01/79670 | A1 | * | 10/2001 |
| WO | 02/23021 | A1 | | 3/2002 |

* cited by examiner

CATALYST CARRIER BODY WITH CORRUGATED CASING AND PROCESS FOR PRODUCING THE SAME

CROSS-REFERENCE TO RELATED APPLICATION

This is a continuing application, under 35 U.S.C. § 120, of copending International Application No. PCT/EP03/02678, filed Mar. 14, 2003, which designated the United States; this application also claims the priority, under 35 U.S.C. § 119, of German Patent Application 102 17 259.5, filed Apr. 18, 2002; the prior applications are herewith incorporated by reference in their entirety.

BACKGROUND OF THE INVENTION

FIELD OF THE INVENTION

The present invention relates to a catalyst carrier body having a geometric longitudinal axis, a honeycomb body and a housing. A corrugated casing having an outer side and an inner side is disposed between the honeycomb body and the housing. The outer side of the corrugated casing is connected to the housing by technical joining at attachment sections and the inner side of the corrugated casing is connected to the honeycomb body by technical joining. The invention also relates to a process for producing the catalyst carrier body. Such catalyst carrier bodies are used, in particular, to reduce the level of pollutants in exhaust gases from mobile internal combustion engines.

The most important application area for such catalyst carrier bodies is in the cleaning or purification of exhaust gases from diesel or spark-ignition engines used in automotive engineering. For that purpose, the catalyst carrier bodies are usually provided with a support layer (in particular a wash-coat), which is distinguished by a very large surface area. That support layer is usually impregnated with at least one catalytically active material (e.g. platinum, rhodium or the like). When the exhaust gas comes into contact with those catalytically active materials, the pollutants contained in the exhaust gas, such as for example carbon monoxide, unsaturated hydrocarbons, nitrogen monoxide or the like, are reduced. In order to allow a relatively large surface area to be provided for the support layer, the catalyst carrier bodies are usually equipped with a honeycomb body which has a multiplicity of passages through which a fluid can flow. Ceramic, extruded and metallic honeycomb bodies are known in that context. The honeycomb bodies are generally introduced into a housing which, in turn, is directly integrated in an exhaust pipe. The catalyst carrier body is exposed to high thermal and dynamic loads in a mobile exhaust system of that type.

The thermal loads result, for example, on one hand from the temperature of the exhaust gas itself. That temperature increases when the catalyst carrier body is disposed closer to the internal combustion engine. On the other hand, the chemical, catalytic conversions of the pollutant components in the exhaust gas also lead to an increase in the temperature of the catalyst carrier body, since those conversion reactions are generally exothermic, and consequently under certain circumstances temperatures which are significantly higher than the temperature of the exhaust gas itself are reached. The main influences with regard to the dynamic loads result from the combustion process and external vibration excitations. Since the combustion process takes place intermittently in the internal combustion engine, the resulting pressure surges continue periodically and through the entire exhaust system.

External vibration excitation occurs, for example, as a result of unevenness of the roadway over which the automobile is traveling. Due to that high thermal and dynamic loading, a permanent connection of the honeycomb body to the housing is of particular interest. That connection must on one hand be suitable to compensate for differing thermal expansion characteristics of the honeycomb body compared to the housing, and on the other hand must prevent the honeycomb body from becoming detached from the housing in the long term.

In particular, with a view to the use of metallic honeycomb bodies and permanent attachment to a metallic housing, it is known for the connection of the honeycomb body to the housing to be effected through the use of an intermediate layer. An inner side of the intermediate layer is connected to the honeycomb body, while an outer side is connected to the housing. An intermediate layer of that type is known, for example, from Japanese Patent Application JP 04-222636 A. In that document, the intermediate layer is constructed as a corrugated metal sheet and is connected on one side to the honeycomb body and on the other side to the housing. The honeycomb body described therein includes a smooth metal sheet and a corrugated metal sheet, which are rolled together in spiral form to form a cylindrical honeycomb body. The outer boundary of the honeycomb body is formed by a smooth metal sheet. Under that assumption, attachment through the use of the corrugated metal sheet is relatively problem-free, since a virtually smooth surface of the honeycomb body is provided.

However, other configurations of the sheet-metal foils are also known. Those include, in particular, honeycomb bodies which are formed from a multiplicity of smooth and corrugated sheet-metal foils that are disposed alternately and are then bent in an S shape and/or a U shape. For a more detailed description of metallic honeycomb bodies of that type, reference should be made in particular to European Patent Application 0 245 737, corresponding to U.S. Pat. No. 4,832,998, U.S. Pat. No. 4,946,822, U.S. Pat. No. 4,803,189A and U.S. Pat. No. 4,923,109; International Patent Application No. WO 90/03220, corresponding to U.S. Pat. No. 5,105,539 and U.S. Pat. No. 5,139,844; and German Published, Non-Prosecuted Patent Application DE 37 43 723, corresponding to U.S. Pat. No. 4,193,793 and to U.S. Pat. No. 3,849,076. The content of the disclosure of those documents is hereby fully incorporated herein by reference.

Attachment of a honeycomb body to a housing which is durable in the long term is not easy to achieve and must form the subject of numerous structural proposals. Achieving that object is made more difficult by the fact that in the future ever thinner foils will be used, making long-term attachment even more difficult. In that context, it is important on one hand to satisfy the current statutory regulations and/or the future standards which are likely to come to the fore, and on the other hand to ensure inexpensive production, which is suitable for series manufacture, of catalyst carrier bodies of that type. One central aspect in that respect is the precise spatial definition of connections produced by technical joining between the individual components of the catalyst carrier body. Since determination of the local or spatial configuration of connection locations can be determined, for example, with the aid of computer-aided simulation programs, it is also necessary to ensure that the connections formed by technical joining during manufacture itself are formed accurately and only at the desired locations. The preferred manner of producing the technical joining connection is by brazing. However, a sintering process or even welding may be used as well.

It is customary for connections made by technical joining of that nature to be produced through the use of a welding or brazing process. In that context, the welding process offers the advantage that an increase in the temperature of the housing or the honeycomb body can be applied very successfully on a local or spatial basis. However, one drawback is that different forms of changes to the microstructure of the individual components can occur even during production of the catalyst carrier body in that case, and consequently even at that point in time the individual components may already have high internal stresses. One main problem of the brazing process is the flow property of the brazing material during a heat treatment. As has already been stated above, honeycomb bodies of that type in many cases include small passages, with capillaries, in which the liquefied brazing material spreads out through capillary action being formed in particular in the corners of passages of that type and/or at contact points between adjacent components (e.g. metal foils, etc.). That flow generally also takes place counter to the external weight and if appropriate also over the entire length of a catalyst carrier body. The result thereof is that undesired connection regions are produced in particular with regard to the use of a corrugated intermediate layer of that type.

In the case of thermally highly loaded honeycomb bodies, i.e. in particular catalyst carrier bodies installed close to the engine, which are constructed from thin metal sheets, in particular metal sheets with a thickness of less than 30 μm or even less than 25 μm, after a prolonged operating time it is observed that those carrier bodies are deformed by a barreling effect. The diameters of the end sides become smaller than the original diameter, whereas the original diameter is retained in the central region. That barreling deformation is not necessarily precisely symmetrical at the two end sides, depending on the particular operating conditions. A corrugated casing can to some extent counteract that deformation if it is produced from a thicker material and is connected to the honeycomb body at the end sides. However, if it is too rigid, the honeycomb body becomes torn off at the end sides over the course of time, whereas if it is too soft, it will simply bend with the end sides. Therefore, it is necessary to find a compromise with regard to the rigidity of the corrugated casing. Even if an optimum compromise is found, over the course of the service life the corrugated casing bends inward together with the end sides of the honeycomb body, thereby applying a load to its external connection to the housing which can cause it to become detached.

SUMMARY OF THE INVENTION

It is accordingly an object of the invention to provide a catalyst carrier body with a corrugated casing and a process for producing the same, which overcome the hereinaforementioned disadvantages of the heretofore-known products and processes of this general type and which provide a connection between a honeycomb body and a housing that is as durable as possible, in particular for honeycomb bodies made from thin metal sheets. In addition, the catalyst carrier body is to have a simple construction and to ensure stable attachment of the honeycomb body even under high thermal and dynamic loads. Furthermore, it is a primary requirement that the process be easy to carry out as part of series production.

With the foregoing and other objects in view there is provided, in accordance with the invention, a catalyst carrier body, comprising a geometric longitudinal axis, a honeycomb body, a housing, and a corrugated casing having an outer side and an inner side. The corrugated casing is disposed between the honeycomb body and the housing. The outer side of the corrugated casing is connected to the housing at attachment sections by technical joining and the inner side of the corrugated casing is connected to the honeycomb body by technical joining. The attachment sections lie substantially on a common circumferential line, have the shortest possible width in direction of the longitudinal axis, and have an overall surface area dimensioned to permit the attachment sections to securely hold the honeycomb body under operating conditions. The following features can also be combined with one another in each case.

Heretofore, the attachment of a honeycomb body to a housing with or without an intermediate corrugated layer has generally been effected by using generously dimensioned strips of brazing material. However, those produce much larger attachment surface areas than required for mechanically secure holding of the honeycomb body. Those attachment surfaces in particular have a large extent in the direction of the longitudinal axis, with the result that the length available for bending the corrugated casing or lateral casing is shortened, leading to faster destruction of the corrugated casing under operating conditions. The invention provides a remedy to that problem by tightly limiting the axial extent of the attachment sections. Of course, the total surface area of the attachment sections must not become so small that they are no longer able to reliably hold the honeycomb body under dynamic loads. Nevertheless, it is possible to significantly reduce the size of the sections as compared to the prior art, thereby crucially increasing the available axial bending length for the corrugated casing. Whereas on the inner side, the corrugated casing is preferably connected to the honeycomb body over its entire length, thereby reducing the barreling deformation thereof but also following this deformation, on the outer side it is only connected to the housing over a very small axial region amounting in particular to less than 10 mm, preferably less than 6 mm and very particularly preferably less than 4 mm. The axial length required for the attachment sections can be calculated by using the following considerations for one specific application: the total surface area of all the attachment sections must be able to support the weight of the coated honeycomb body under the accelerations which are to be expected in practice. Due to vibrations, by way of example, a loading of 150 g (150 times the acceleration caused by gravity) is assumed. The total surface area of the attachment sections is dependent firstly on the number of attachment sections, i.e. the number of corrugation peaks, which are in contact with the housing. It is possible to assume that a good brazed joint will be able to withstand maximum loads of 2.5 $N/mm^2$, which for a given weight and expected acceleration gives the minimum total surface area for the attachment sections. The required axial width of the attachment sections can then be roughly calculated using the small amount of empirical experience gained with regard to the width of a typical attachment section in the circumferential direction, which is also to some extent dependent on the corrugation shape of the corrugated casing, and using the number of corrugation peaks. Surprisingly, even with an added safety margin, generally only a very narrow width, on the order of magnitude mentioned above, is required. The thinner the metal sheets of a honeycomb body, the lower its weight and therefore the narrower it is possible for the attachment sections to be too.

In accordance with another feature of the invention, the housing normally has a thickness of from 0.6 mm to 2 mm. The corrugated casing is distinguished by its corrugation peaks or valleys which run in the direction of the longitudinal axis and form the desired corrugation structure. The specific configuration of the corrugation structure is to be selected on an application-specific basis. An approximately sinusoidal or similar corrugation structure has preferably already proven to be highly suitable. The corrugation compensates, for example, for expansion or contraction of the honeycomb body in the circumferential direction, by virtue of the fact that the adjacent corrugation peaks or valleys move away from one another or move closer together.

In accordance with a further feature of the invention, the catalyst carrier body described herein is provided with at least one strip of brazing material. This strip of brazing material (at least prior to a heat treatment of the catalyst carrier body) generally includes a brazing material which is in strip form and is fixed to the corrugated casing, if appropriate with the aid of adhesives or binders. The strip of brazing material itself may if appropriate also include further chemical components. The corrugated casing and/or the housing then have at least one brazing-limiter, which is formed as a coating, as a surface machining or in particular as a geometric configuration. For example, any gap above a certain size prevents the further spread of brazing material through capillary effects. Surfaces which repel brazing material or at least prevent brazing, in particular oxidized surfaces, also effectively delimit the attachment regions.

In accordance with an added feature of the invention, a preferred brazing-limiter is at least one sharp edge, since a sharp edge forms a gap between the fitted corrugated casing and the housing. During production of the connections by technical joining, this gap functions as a type of brazing material stop, since the presence of this gap interrupts capillaries which are present and therefore also prevents an undesirable flow of brazing material. Sharp edges of this type are preferably disposed in the immediate vicinity of the edge of the strip of brazing material, in particular at a distance of less than 2 mm, preferably less than 1 mm and advantageously less than 0.5 mm, therefrom. This allows accurate spatial delimitation of connections by technical joining. The formation of sharp edges in the corrugated casing and/or in the housing can be realized relatively easily, and it is also possible, for example, to dispense with the use of additional materials, such as ceramic coatings, etc.

In accordance with an additional feature of the invention, the at least one strip of brazing material is formed all the way around the outer side of the corrugated casing and is disposed centrally with respect to an extent of the corrugated casing in the direction of an axis. The substantially central configuration of the strip of brazing material and/or of the formation of a corresponding connection by technical joining in this region is advantageous, on one hand, because when the honeycomb body is heated or cooled, a dynamic expansion or contraction is observed in particular in the vicinity of its end sides. On the other hand, this means that in relative terms the relative movements between the two components are minor in particular in the centrally located region. In this respect, this position is particularly suitable for attachment of the corrugated casing to the housing. Given a central configuration, there is also no need to take into account the subsequent installation position of the honeycomb body. However, in practice it may be the case that the two end sides are subject to different levels of loading and therefore shrink to differing extents. In this case, the strip of brazing material is preferably disposed slightly eccentrically toward the end side which shrinks to a lesser extent.

In accordance with yet another feature of the invention, the housing has at least one notch which forms at least one parallel sharp edge. The at least one sharp edge which is formed ends flush with a strip of brazing material, i.e. the sharp edge advantageously lies directly at the strip of brazing material. It is very particularly advantageous for the housing to be provided with a plurality of notches, the sharp edges of which, by way of example, delimit an encircling strip of brazing material on both sides, i.e. from both encircling edges. This produces a defined contact region, with the brazing material which is contained in the strip of brazing material also in reality running only between these two sharp edges. This ensures that a sufficient quantity of brazing material remains in the intended attachment region even during and after a heat treatment of the catalyst carrier body.

In accordance with yet a further feature of the invention, in addition to its corrugation structure running substantially parallel to the axis, the corrugated casing has at least one transverse structure which forms at least one sharp edge. The transverse structure is generally constructed with a height of less than 1 mm, and is advantageously also formed all the way around. In general, the at least one transverse structure is superimposed on the corrugation structure of the corrugated casing running parallel to the axis. The transverse structure in this case functions as a spacer spacing the corrugated casing from the housing, likewise allowing capillary effects to be interrupted.

However, the result of this could also be that an unnecessarily large annular gap could be formed in this case between the corrugated casing and the housing, in which possibly hot, untreated exhaust gas could accumulate. In order to prevent this, in accordance with yet an added feature of the invention, it is advantageous if the at least one transverse structure is directed radially outward, with the housing preferably having at least one compatible, i.e. correspondingly adapted, recess, so that a gap is formed between the at least one transverse structure and the at least one recess. This produces a type of labyrinth seal, with an undesired bypass of hot, untreated exhaust gas during use of the catalyst carrier body or an undesired flow of brazing material as part of the production of connections by technical joining being prevented by the fact that the transverse structure and recess engage in one another "without contact".

In accordance with yet an additional feature of the invention, the corrugated casing, in addition to its corrugation structure running substantially parallel to the axis, has at least one microstructure which is preferably disposed close to at least one boundary of the corrugated casing. In this case, preferably in each case, a plurality of microstructures are formed all the way around, perpendicular to the axis. The microstructures have the function of making the corrugated casing more bendable in the axial direction in certain sections. Due to its corrugation structure running substantially parallel to the axis, the corrugated casing itself is relatively rigid in form, but this can be at least locally altered through the use of the microstructure proposed herein. This is of particular interest since the honeycomb body preferably adopts a barrel-like form during cooling, i.e. the regions of the honeycomb body in the vicinity of the end sides have a cross section with a smaller area than centrally disposed regions. The cause of this is on one hand the relatively large quantity of heat which is stored in the interior of the honeycomb body and the rapid cooling from outside or close to the end sides. A cooling behavior of this type requires the corrugated casing to follow such deformation without allowing the thermal stresses produced in doing so to be so high as to possibly lead to the connections formed by technical joining becoming detached. Precisely this can be achieved by microstructures of this type, with preferably 3 to 10 microstructures in each case in the vicinity of an end side of the honeycomb body being superimposed on the corrugation structure. With regard to the form and production of microstructures of this type, reference should be made at this point to European Patent Application 0 784 507 corresponding to U.S. Pat. No. 5,795, 658 and U.S. Pat. No. 5,902,558, the content of which is hereby incorporated herein in full by reference.

In accordance with again another feature of the invention, the casing has at least one connection region for connections by technical joining to the honeycomb body. This at least one connection region is disposed on the inner side of the corrugated casing, in the vicinity of an end side of the honeycomb body, in particular ending flush therewith. In long-term tests, it has turned out that it is particularly advantageous to provide just one connection region, which is therefore formed over the entire length of the honeycomb body or over the entire extent of the corrugated casing and all the way around. The corrugated casing in this case has materials properties which, in particular with regard to the surface area-specific heat capacity, are approximately between those of the housing, on one hand, and those of the honeycomb body or the metal foils forming the honeycomb body, on the other hand. A sufficient freedom of expansion or contraction of the honeycomb body is achieved by virtue of only the corrugation peaks or valleys of the corrugated casing being connected to the honeycomb body, i.e. in this case a multiplicity of small, strip-like connections being formed along these extremes of the corrugated structure.

However, in accordance with again an added feature of the invention, it is also possible, in particular in the case of catalyst carrier bodies which are not to be exposed to excessively high thermal and dynamic loads, to provide at least two connection regions, with at least one of these connection regions being disposed at the end side of the corrugated casing, in the vicinity of an end side of the honeycomb body, in particular ending flush therewith. In this context, it may be particularly advantageous for a connection region of this type in each case to be formed starting from the end side of the honeycomb body over a length of from 5 to 20 mm between the honeycomb body and the corrugated casing, whereas fixing of the corrugated casing to the housing takes place in the central region.

In accordance with again an additional feature of the invention, the housing has at least one undercut which, as seen in the radial direction, is at least partially superimposed on at least one connection region. An undercut of this type also serves to ensure that the very different thermal expansion behavior of the honeycomb body and the housing takes place in particular in the region of the end sides. The undercut in turn leads to the formation of a gap between the corrugated casing and the housing, so that an undesirable flow of brazing material is avoided. In this context, it should also be pointed out that the housing may in principle be constructed to be longer or shorter than the honeycomb body or the corrugated casing. However, it is preferable for the honeycomb body, corrugated casing and housing to be flush with one another.

In accordance with still another feature of the invention, with regard to the corrugated casing, it is advantageous for the latter to have a casing thickness of from 0.08 mm to 0.25 mm. The corrugation structure is preferably constructed with a corrugation length of from 1.5 mm to 4 mm and a corrugation height of from 0.5 mm to 2 mm. A corrugated casing of this type is formed, for example, of a nickel-chromium-iron alloy with a high carbon content and with additions of the microalloying elements titanium, zirconium and of aluminum and yttrium. The chemical composition of the corrugated casing in this case is distinguished by the following constituents: Cr (24-26%), Fe (8-11%), C (0.15-0.25%), Mn (0.1%), Si (0.5%), Cu (0.1%), Al (1.8-2.4%), Ti (0.1-0.2%), Y (0.05-0.12%), Zr (0.01-0.1%), and a remainder of a nickel base. The corrugated casing in this case has an extraordinary resistance to oxidation at high temperatures, a very good resistance to corrosion and excellent high-temperature creep properties, in particular even under cyclical conditions. Such a configuration of the corrugated casing has proven particularly advantageous for metallic honeycomb bodies which have a cylindrical structure with a diameter of less than 100 mm and a length of approximately 75 mm.

With the objects of the invention in view, there is also provided a process for producing a catalyst carrier body, which comprises producing a honeycomb body, producing a housing, and producing a corrugated casing having an outer side and an inner side. The corrugated casing and/or the housing are provided with at least one brazing material limiter. At least one strip of brazing material is provided on the corrugated casing, substantially parallel to the at least one brazing material limiter. The honeycomb body surrounded by the corrugated casing is inserted into the housing, defining a geometric longitudinal axis, and delimiting an attachment section having the at least one strip of brazing material through use of the at least one brazing material limiter. Connections are formed by technical joining at least between the inner side of the corrugated casing and the honeycomb body as well as between the outer side of the corrugated casing and the housing. The strip of brazing material is prevented from spreading out through use of the brazing material limiter. A process of this type is suitable in particular for the production of a catalyst carrier body as has already been described above.

In accordance with another mode of the invention, in this context, it is once again particularly advantageous for a strip of brazing material to be formed all the way around the outer side of the corrugated casing and to be disposed centrally with regard to an extent of the corrugated casing in the direction of an axis.

In accordance with a further mode of the invention, the honeycomb body is produced by stacking and/or winding at least partially structured sheet-metal foils which are disposed alternately in such a way that passages through which a fluid can flow and which preferably run substantially parallel to the axis, are formed. With regard to the production of the honeycomb body, at this point reference should also be made to the content of the disclosure of European Patent Application 0 245 737, corresponding to U.S. Pat. No. 4,832,998 and U.S. Pat. No. 4,923,109; International Patent Application No. WO 90/03220, corresponding to U.S. Pat. No. 5,105,539 and U.S. Pat. No. 5,139,844, and German Published, Non-Prosecuted Patent Application DE 37 43 723, corresponding to U.S. Pat. No. 4,193,793 and U.S. Pat. No. 3,849,076. In this context, it should also be noted that sheet-metal foils of this type preferably have a thickness of less than 50 μm, in particular less than 22 μm and preferably less than 15 μm. This forms honeycomb bodies with a passage density per unit cross-sectional area which is advantageously in the range from 500 cpsi (cells per square inch) to 1800 cpsi.

In accordance with a concomitant mode of the invention, the honeycomb body is initially introduced with the corrugated casing only part way into the housing, and is then provided with an adhesive on the end side, pushed in fully and then likewise provided with a brazing material in powder form on the end side before connections by technical joining are formed. The partial introduction of the honeycomb body together with the corrugated casing into the housing leads to the individual sheet-metal foils being adequately fixed with respect to one another in terms of their relative position. An adhesive is introduced by the end-side contact with the adhesive and using the capillary effects in the sections which subsequently serve as the connection region. The above-mentioned sharp edges in this case too serve to delimit the flow of adhesive. After the honeycomb body with the corrugated casing has been introduced into the housing, pulverulent brazing material is blown into inner regions of the honeycomb body, for example with the aid of compressed air, with the brazing powder sticking to the adhesive which has previously been introduced. The formation of connections by technical joining between the individual sheet-metal foils, between the sheet-metal foils and the corrugated casing, and between the corrugated casing and the housing, is preferably effected as part of a high-temperature vacuum process.

Other features which are considered as characteristic for the invention are set forth in the appended claims.

Although the invention is illustrated and described herein as embodied in a catalyst carrier body with a corrugated casing and a process for producing the same, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
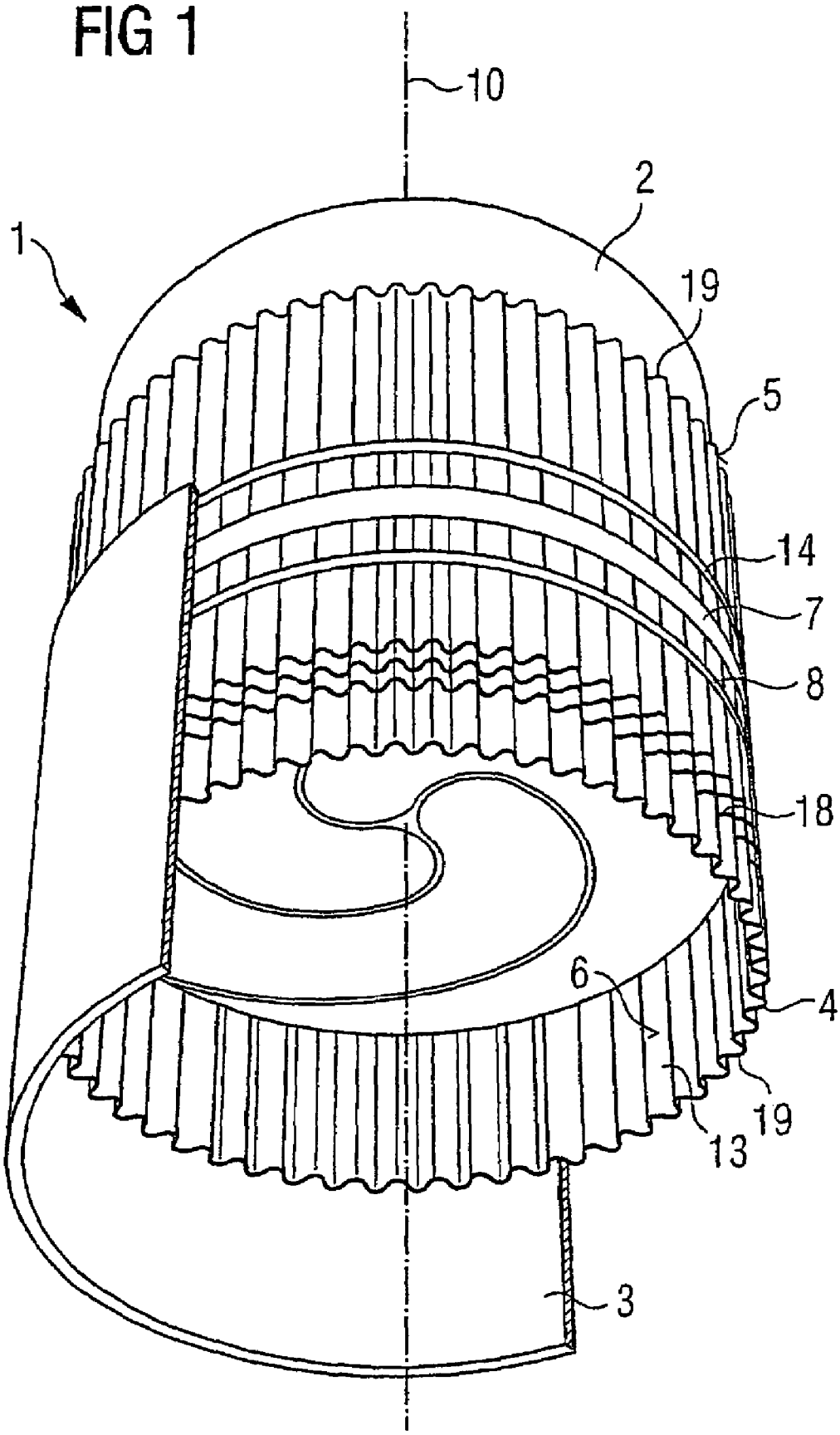
FIG. 1 is a diagrammatic, perspective view of a configuration of a catalyst carrier body according to the invention.

Referring now to the figures of the drawings in detail and first, particularly, to FIG. 1 thereof, there is seen a diagrammatic and perspective illustration of one configuration of a catalyst carrier body 1, including a honeycomb body 2 and a housing 3. A corrugated casing 4 having an outer side 5 and an inner side 6 is disposed between the honeycomb body 2 and the housing 3. The outer side 5 of the corrugated casing 4 is connected to the housing 3 by technical joining and the inner side 6 of the corrugated casing 4 is connected to the honeycomb body 2 by technical joining. In this case, the centrally disposed connection of the corrugated casing 4 to the housing 3 by technical joining is executed through the use of a strip of brazing material 7. In order to prevent this strip of brazing material 7 or the brazing material which it contains from penetrating into undesired regions during a heat treatment of the catalyst carrier body 1, the corrugated casing 4 is provided with two transverse structures 14, each of which form sharp edges 8 in order to interrupt the capillary effect described above. The sharp edges 8 thus cause the transverse structures 14 to form a brazing material limiter.

Figure 2:
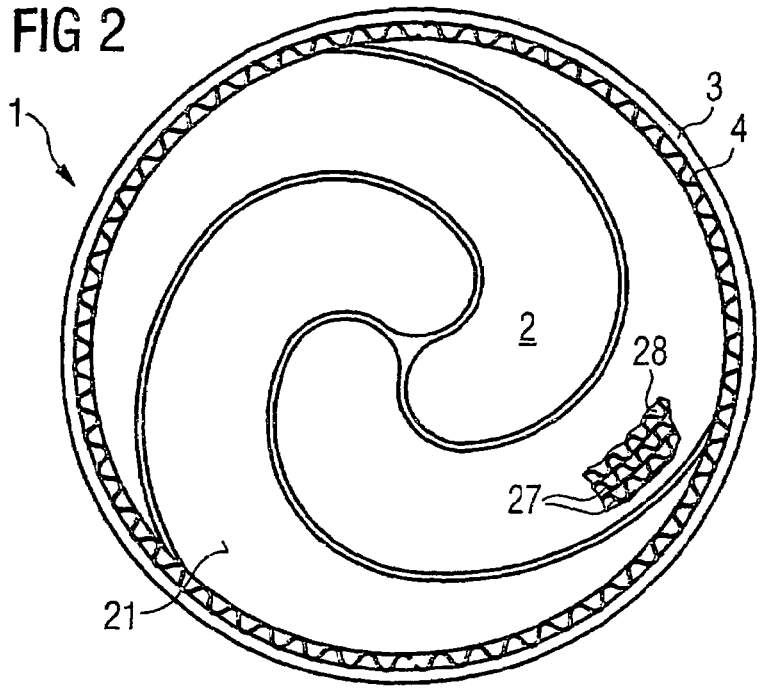
FIG. 2 is an end-elevational view of a configuration of the catalyst carrier body.
Figure 4:
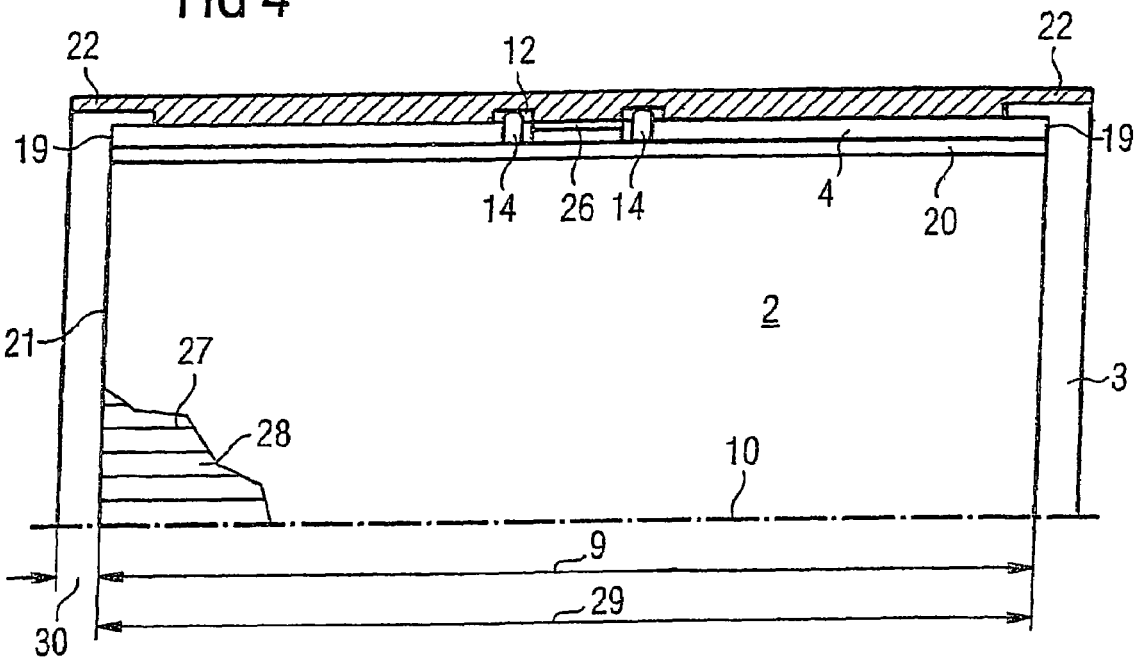
FIG. 4 is a partly broken-away, longitudinal-sectional view of a further configuration of a catalyst carrier body.

The corrugated casing 4 has a corrugation structure 13 running substantially parallel to an axis 10 and is additionally provided with a plurality of encircling microstructures 18 in the vicinity of end sides 21 (shown in FIGS. 2 and 4). The microstructures 18 are responsible for the ability of the corrugated casing 4 to yield in the radial direction, in particular in the vicinity of boundaries 19 of the corrugated casing 4.

FIG. 2 is a diagrammatically illustrated, end-elevational view of a catalyst carrier body 1 according to the invention. In this case, the honeycomb body 2 is constructed with four wound stacks of smooth and corrugated sheet-metal foils 27. The alternately disposed smooth and corrugated sheet-metal foils 27 form passages 28 which subsequently serve to fix a catalytically active support layer required for the conversion of pollutants. These passages 28 extend from one end side 21 to the opposite end side 21 substantially parallel to the axis 10. The honeycomb body 2 is mounted in the stable housing 3, with the corrugated casing 4 being disposed between the honeycomb body 2 and the housing 3 and serving to compensate for different thermal expansion characteristics of the housing 3 and the honeycomb body 2.

Figure 3:
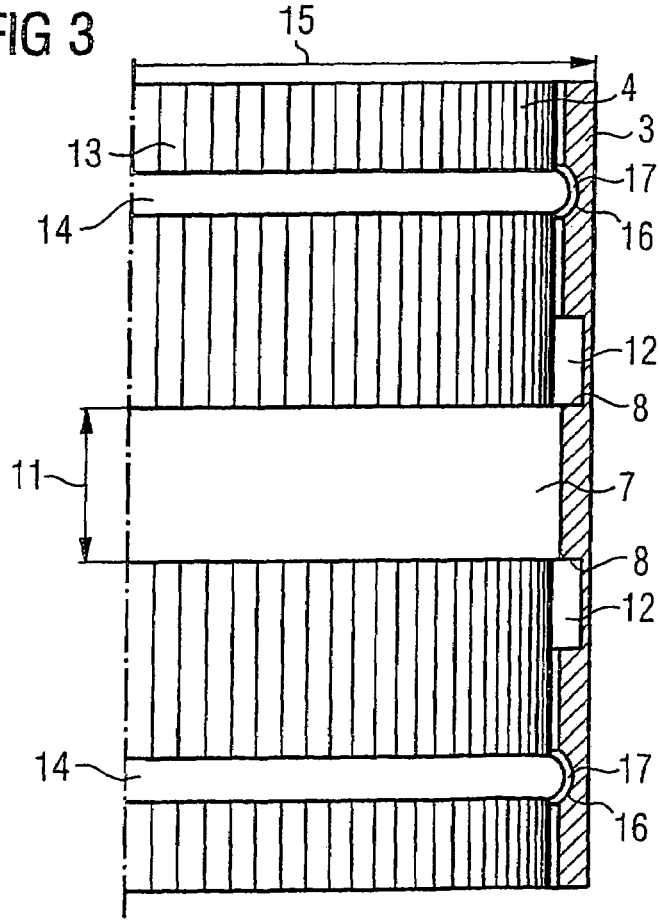
FIG. 3 is a fragmentary, partly sectional view of a further configuration of the catalyst carrier body.

FIG. 3 is a fragmentary, diagrammatic, partially sectional illustration of a configuration of the catalyst carrier body 1. This figure once again shows a corrugated casing 4 with a corresponding corrugation structure 13. Two transverse structures 14 are superimposed on the corrugation structure 13. If appropriate, the transverse structures 14 define an attachment section for attaching the corrugated casing 4 to the housing 3 by preventing a strip of brazing material 7, illustrated in the center and having a width 11, from flowing beyond the transverse structures 14 during a heat treatment of the catalyst carrier body 1. The transverse structures 14 extend outward in the direction of a radius 15. The housing 3 has corresponding recesses 16, so that a gap 17 is nevertheless ensured between the transverse structures 14 and the housing 3.

As an alternative or in addition to the transverse structures 14 of the corrugated casing 4, the housing 3 may also be provided with notches 12, which likewise interrupt a flow of brazing material resulting from a capillary action between the corrugation structure 13 of the corrugated casing 4 and the housing 3. The notches 12 form sharp edges 8 which, by way of example, are at a distance from one another which substantially corresponds to the width 11 of the strip of brazing material 7. This ensures that the brazing material is prevented from flowing beyond the original width 11 of the strip of brazing material 7. The sharp edges 8 thus cause the notches 12 to form a brazing material limiter.

FIG. 4 is a longitudinal-sectional view through a further configuration of a catalyst carrier body 1. In this case, the honeycomb body 2 is once again constructed with sheet-metal foils 27 which form passages 28 extending from one end side 21 to the opposite end side 21. In the illustrated embodiment, a length 29 of the honeycomb body 2 and an extent 9 of the corrugated casing 4 correspond to one another. In this case, a connection region 20 between the corrugated casing 4 and the honeycomb body 2 is likewise formed over the entire length 29 or extent 9. The housing 3, by contrast, is constructed to be longer, so that in each case a projecting section 30 is formed. In this case, an attachment section 26 (formed by the strip of brazing material 7) between the corrugated casing 4 and the housing 3 is delimited in each case by two transverse structures 14 of the corrugated casing 4 and two notches 12 in the housing 3. Moreover, the housing 3 has undercuts 22 in the region of the boundaries 19 of the corrugated casing 4, which prevent the housing 3 from being attached to the corrugated casing 4, in particular in the vicinity of the end sides 21.

Figure 5:
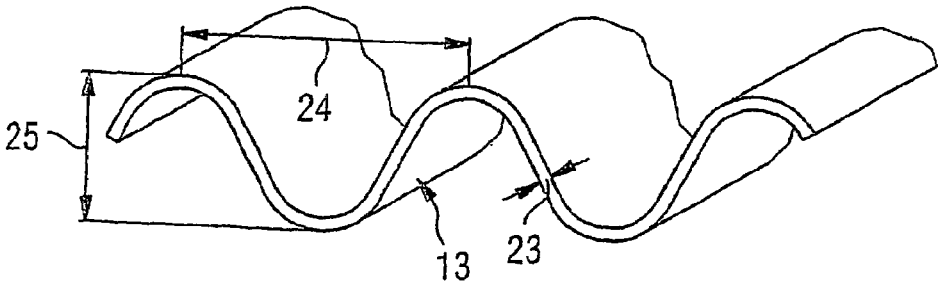
FIG. 5 is a fragmentary, perspective view of a corrugated casing.

FIG. 5 shows a diagrammatic and perspective illustration of one configuration of a corrugated casing 4. The corrugated casing 4 has a material thickness 23, a corrugation height 25 and a corrugation length 24. The thickness 23 is preferably in the range from 100 μm to 200 μm. The specific configuration of the corrugation structure is always to be selected suitably for the expected thermal and dynamic loads on the catalyst carrier body in the exhaust system of a mobile internal combustion engine. In this context, by way of example, corrugation lengths 24 of from 1.5 mm to 4 mm and corrugation heights 25 of from 0.5 mm to 2 mm have proven advantageous.

We claim:

1. A catalyst carrier body, comprising:

a geometric longitudinal axis;

a honeycomb body having a plurality of layers;

a housing; and a corrugated casing having an outer side and an inner side, said corrugated casing being disposed between said honeycomb body and said housing;

said outer side of said corrugated casing being connected to said housing at attachment sections by technical joining and said inner side of said corrugated casing being connected to said plurality of layers of said honeycomb body by technical joining;

said attachment sections lying substantially on a common circumferential line, having a shortest possible width in a direction of said longitudinal axis, and having an overall surface area dimensioned to permit said attachment sections to securely hold said honeycomb body under operating conditions;

said attachment sections formed by brazing material; and at least one of said corrugated casing and said housing having at least one brazing material limiter extending substantially parallel to said brazing material and delimiting said brazing material in said direction of said longitudinal axis.

2. The catalyst carrier body according to claim 1, wherein said honeycomb body has an extent, and said attachment sections are disposed approximately centrally around said honeycomb body relative to said extent of said honeycomb body in said direction of said longitudinal axis.

3. The catalyst carrier body according to claim 1, wherein said honeycomb body has an extent, and said attachment sections are disposed eccentrically around said honeycomb body relative to said extent of said honeycomb body in said direction of said longitudinal axis.

4. The catalyst carrier body according to claim 1, wherein said attachment sections have a width of less than 10mm in said direction of said longitudinal axis.

5. The catalyst carrier body according to claim 1, wherein said attachment sections have a width of less than 6mm in said direction of said longitudinal axis.

6. The catalyst carrier body according to claim 1, wherein said attachment sections have a width of less than 4mm in said direction of said longitudinal axis.

7. The catalyst carrier body according to claim 1, wherein said at least one brazing material limiter is at least one of a coated and a machined surface region of at least one of said corrugated casing and said housing.

8. The catalyst carrier body according to claim 1, wherein said at least one brazing material limiter is at least one notch.

9. The catalyst carrier body according to claim 1, wherein said corrugated casing has a corrugation structure extending substantially parallel to said longitudinal axis and at least one transverse structure forming said at least one brazing material limiter.

10. The catalyst carrier body according to claim 9, wherein said at least one transverse structure is directed radically outward.

11. The catalyst carrier body according to claim 10, wherein said housing has at least one recess formed therein compatible with said at least one transverse structure, forming a gap between said at least one transverse structure and said at least one recess.

12. The catalyst carrier body according to claim 1, wherein said corrugated casing has a corrugation structure extending substantially parallel to said longitudinal axis, and said corrugated casing has at least one microstructure.

13. The catalyst carrier body according to claim 12, wherein said corrugated casing has at least one boundary, and said at least one microstructure is disposed close to said at least one boundary.

14. The catalyst carrier body according to claim 12, wherein said at least one microstructure is a plurality of completely encircling microstructures perpendicular to said longitudinal axis.

15. The catalyst carrier body according to claim 1, wherein said honeycomb body has end sides, and said corrugated casing has at least two connection regions for connection to said honeycomb body by technical joining, said connection regions being disposed on said inner side of said corrugated casing in vicinity of said end sides of said honeycomb body.

16. The catalyst carrier body according to claim 15, wherein said connection regions end flush with said end sides of said honeycomb body.

17. The catalyst carrier body according to claim 15, wherein said housing has at least one undercut being at least partially superimposed on at least one of said connection regions, as seen in radial direction.

18. The catalyst carrier body according to claim 1, wherein said corrugated casing has a casing thickness of from 0.08mm to 0.25mm.

19. The catalyst carrier body according to claim 9, wherein said corrugated casing has a casing thickness of from 0.08mm to 0.25mm, and said corrugation structure has a corrugation length of from 1.5mm to 4mm and a corrugation height of from 0.5mm to 2mm.

20. The catalyst carrier body according to claim 12, wherein said corrugated casing has a casing thickness of from 0.08mm to 0.25mm, and said corrugation structure has a corrugation length of from 1.5mm to 4mm and a corrugation height of from 0.5mm to 2mm.

21. A process for producing a catalyst carrier body, which comprises the following steps:

producing a honeycomb body;

producing a housing;

producing a corrugated casing having an outer side and an inner side;

providing at least one of the corrugated casing and the housing with at least one brazing material limiter;

placing at least one strip of brazing material on the corrugated casing, substantially parallel to the at least one brazing material limiter;

inserting the honeycomb body surrounded by the corrugated casing into the housing, defining a geometric longitudinal axis, and delimiting an attachment section having the at least one strip of brazing material through use of the at least one brazing material limiter;

forming connections by technical joining at least between the inner side of the corrugated casing and the honeycomb body as well as between the outer side of the corrugated casing and the housing; and preventing the strip of brazing material from spreading out through use of the brazing material limiter.

22. The process according to claim 21, which further comprises placing the at least one strip of brazing material having a width of less than 10mm entirely around the outer side of the corrugated casing and centrally around the honeycomb body relative to an extent of the honeycomb body in direction of the longitudinal axis.

23. The process according to claim 21, which further comprises placing the at least one strip of brazing material having a width of less than 6mm entirely around the outer side of the corrugated casing and centrally around the honeycomb body relative to an extent of the honeycomb body in direction of the longitudinal axis.

24. The process according to claim 21, which further comprises placing the at least one strip of brazing material having a width of less than 4mm entirely around the outer side of the corrugated casing and centrally around the honeycomb body relative to an extent of the honeycomb body in direction of the longitudinal axis.

25. The process according to claim 21, which further comprises placing the at least one strip of brazing material having a width of less than 10mm entirely around the outer side of the corrugated casing and eccentrically around the honeycomb body relative to an extent of the honeycomb body in direction of the longitudinal axis.

26. The process according to claim 21, which further comprises placing the at least one strip of brazing material having a width of less than 6mm entirely around the outer side of the corrugated casing and eccentrically around the honeycomb body relative to an extent of the honeycomb body in direction of the longitudinal axis.

27. The process according to claim 21, which further comprises placing the at least one strip of brazing material having a width of less than 4mm entirely around the outer side of the corrugated casing and eccentrically around the honeycomb body relative to an extent of the honeycomb body in direction of the longitudinal axis.

* * * * *